US005088796A

United States Patent [19]

Plaga

[11] Patent Number: 5,088,796

[45] Date of Patent: Feb. 18, 1992

[54] SEAM-MINING APPARATUS

[75] Inventor: Kurt Plaga, Herne, Fed. Rep. of Germany

[73] Assignee: Bochumer Eisenhutte Heintzmann GmbH & Co KG, Bochum, Fed. Rep. of Germany

[21] Appl. No.: 652,032

[22] Filed: Feb. 7, 1991

[30] Foreign Application Priority Data

Feb. 14, 1990 [DE] Fed. Rep. of Germany ..... 4004488

[51] Int. Cl.[5] ..... F21C 25/56

[52] U.S. Cl. ..... 299/34

[58] Field of Search ..... 299/34, 43, 32

[56] References Cited

FOREIGN PATENT DOCUMENTS 3545302 6/1987 Fed. Rep. of Germany .

1515584 3/1967 France ..... 299/34

987091 1/1983 U.S.S.R. ..... 299/34

1509526 9/1989 U.S.S.R. ..... 299/34

*Primary Examiner*—David J. Bagnell

*Attorney, Agent, or Firm*—Herbert Dubno

[57] ABSTRACT

A seam-mining apparatus has an excavating trough disposed ahead of a conveying trough and an endless chain passes over direction-change devices between these troughs. The excavating and/or conveying tools carried by the chain are articulated and formed with a head portion, an intermediate portion and an end portion. The intermediate portion is connected to the head portion and end portion by pin joints whose axes are perpendicular to the chain and to the bottom of the conveyor trough, and hinge joints whose axes are orthogonal to the axes of the pin joints. The guides for the head and end portions of the troughs extend into the direction-change regions.

6 Claims, 4 Drawing Sheets

SEAM-MINING APPARATUS

FIELD OF THE INVENTION

My present invention relates to a seam-mining apparatus, i.e an apparatus for the mining of mineral matter from a seam or wall by the excavation of the material from the wall or mining face, e.g. by planing, and the conveying of the mined material.

More particularly, the invention relates to an apparatus for the excavation and conveying of seam material, especially coal, utilizing excavating and conveying tools carried on an endless chain having respective passes or stretches extending along an excavating trough and a conveyor trough.

BACKGROUND OF THE INVENTION

It is known to provide an apparatus for the planing of coal, for example, from a seal thereof, utilizing a system in which the coal-planing tools and/or the tools for flights for conveying the excavated material are displaceable along an excavating trough and a conveyor trough. The chain can have respective stretches extending along these troughs.

For example, the conveyor trough may have a horizontal bottom and can be formed with channels on opposite sides of the bottom in which the tool is guided as it is entrained by the chain along this trough. The chain then passes around a direction-change device or wheel at an end of the trough to ride along the excavating trough which is disposed ahead of the conveyor trough in the direction of displacement of the machine toward the coal seam and the face to be mined. The excavating trough also may have channels in which the tool is guided. The excavating trough, moreover, may be mounted so that it can pivot about a horizontal axis relative to the conveyor trough. At the end of the excavating trough, the chain passes around another direction-change device or wheel to return to the conveyor trough.

In operation, the tools plane the coal from the seam and cast the excavated coal into the conveyor trough which carries the excavated material away. The tools then serve as conveyor flights.

In some cases, although not in all, it may be advantageous to provide additional tools which function only as chain conveyor flights and are not provided with planing surfaces or cutters capable of excavating material from the seam face.

At the direction-change devices, the tools must not only be transferred from one trough to the other during a direction change of the chain, but it is necessary to swing the horizontal tools into a substantially upright position as they move onto the excavating trough or from an upright position at the end of the excavating trough into a recumbent position for travel along the conveyor trough.

In the system of German patent document DE 35 45 302 of this type, the tools are functionally rigid and act as one piece units. This applies whether the tool is an excavating tool or only a conveyor flight.

I have found that this type of tool causes problems at the direction-change devices which can only be overcome by terminating the guides for the tool before the tool reaches the direction-change device. As a result, the travel of the tool in the region of the direction-change device becomes unguided and indefinite and there is a danger that the tool and chain will become liberated from the direction-change device and cause breakdown of the apparatus.

OBJECTS OF THE INVENTION

It is, therefore, the principal object of the present invention to provide an improved excavating and conveying machine of the type described which will provide more reliable and controlled travel of the tools in the regions of the direction-change devices.

Another object of the invention is to provide an improved seam-mining apparatus which is more reliable than has heretofore been the case and which, especially, obviates drawbacks of earlier systems particularly with reference to the travel of the tools past the direction-change devices.

SUMMARY OF THE INVENTION

These objects and others which will become apparent hereinafter are attained, in accordance with the invention, in an apparatus of the type previously described and in which each tool comprises a leading or head portion and a trailing or end portion which are spaced apart by an intermediate portion and both of which have laterally-projecting guide formations which are engageable in the guide channels of the conveyor trough and in at least one guide channel of the excavating trough, the head and end portions being pivotally connected with the intermediate portion.

According to the invention, the pivot system connecting the intermediate portion of the tool with either the head portion or the end portion, includes a pivot defining a pivot axis between them which is substantially perpendicular to the bottom of the conveyor trough when the tool is travelling therealong and to the direction of travel of the chain. The pivot system includes a further pivot means forming a pivot axis which is orthogonal to the first mentioned axis between the intermediate portion and the head portion or end portion.

According to the invention, moreover, guide channels extend through the regions of the direction-change devices and are engaged by the formations of the head and end portions of the tool.

Specifically, the seam-mining apparatus of the invention can comprise:

a conveyor trough having a substantially horizontal bottom and tool-guide channels on opposite longitudinal sides of the conveyor trough;

a substantially upright excavating trough ahead of the conveyor trough in a direction of advance of the apparatus toward a seam and extending along the conveyor trough, the excavating trough having at least one tool-guide channel extending therealong;

means for angularly adjusting orientation of the excavating trough about a horizontal axis relative to the conveying trough;

an excavating and conveying chain extending along the troughs;

direction-change devices at opposite ends of the troughs guiding the chain from the conveyor trough to the excavating trough and from the excavating trough to the conveying trough;

a multiplicity of tools spaced along the chain and coupled thereto for entraining excavated material along the conveyor trough, at least some of the tools being formed with planing formations for excavating material from the seam as the tools are displaced along the excavating trough, the tools comprising:

a head portion formed with a pair of laterally oppositely extending guide formations engageable in and guidable by the channels, an end portion spaced from the head portion and formed with a pair of laterally oppositely extending guide formations engageable in and guidable by the channels, an intermediate portion between the head portion and the end portion, respective first pivot means connecting the intermediate portion with the head portion and the end portion for relative pivotal movement about axes substantially perpendicular to a direction of travel of the chain and to the bottom as the tools travel along the conveyor trough, respective second pivot means connecting the intermediate portion with the head portion and the end portion for relative pivotal movement about axes substantially orthogonal to the axes of the first pivot means; and further guide channels formed in regions of the direction-change devices and receiving at least one of the guide formations of each of the head portion and end portion of each tool as each tool is guided respectively from the conveyor trough to the excavating trough and from the excavating trough to the conveying trough.

I have found that the drawbacks previously described no longer arise when a definite guiding of the tool is effected through the direction-change portions of the path of the tool and that this guidance can be provided without problems when the two distinct pivots are provided between the head portion or end portion on the one hand, and the intermediate portion on the other hand. Indeed, the tools pass through the direction-change regions in a stress-free manner. As a result, especially high speeds of the chain and the tools through the direction-change devices can be permitted and the production of the machine significantly improved.

According to a feature of the invention, the first pivot means are pin-and-hole pivot joints while the second pivot means are hinge joints. As noted, some of the tools can be exclusively conveyor tools free from planing formations or cutting teeth engageable with the coal seam. Thus each head portion and end portion of each tool is connected to the intermediate portion by a pin-type joint and by a hinge joint. The parts of the tools are held during operating of the machine in a sufficiently stable form by the pretension of the chain or the tensile forces acting thereon in a kinematic sense in use.

In the case of conveyor flights, it is possible to omit the intermediate portion and connect the head and end portions by the joints described.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
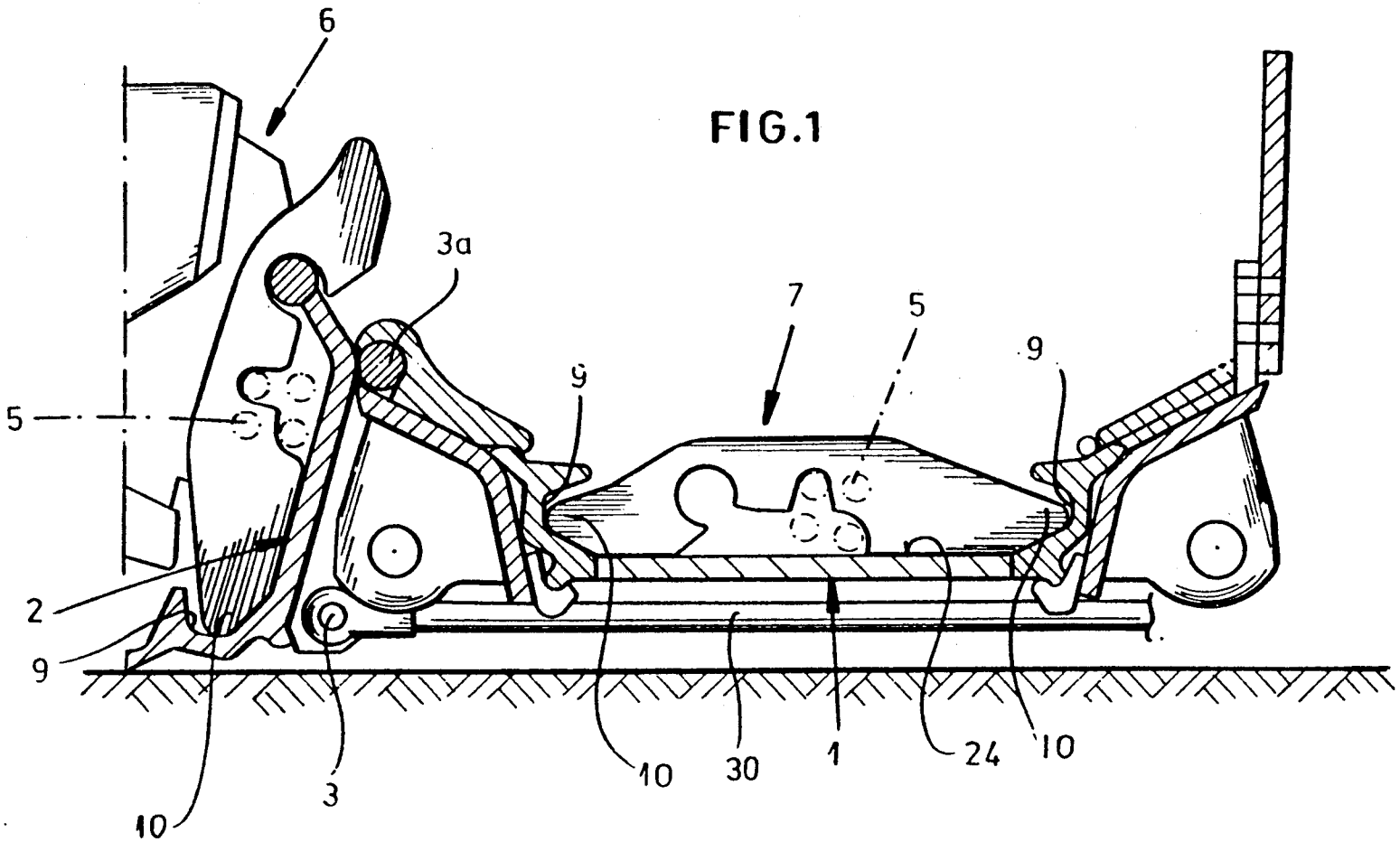
FIG. 1 is a vertical section through an apparatus according to the invention.

The apparatus shown in the drawing serves for the mining of a seam 20 of coal or other mineral matter by the planing away of the face 21 thereof. In particular, the apparatus can be used for the excavation of coal and conveying away the excavated coal.

Basically, the apparatus comprises a conveyor trough 1 and an excavating trough 2, the latter being swingably adjustable about a horizontal axis 3 relative to the conveyor trough 1. At the ends of the troughs, direction-change devices, such as rollers or sprockets 4, are provided and an endless chain 5 passes through these troughs and around the direction-change wheels. The chain entrains the respective excavating tools 6 and, in the embodiment illustrated in the drawing, also conveying tools or flights 7 which are not provided with cutting edges or surfaces capable of excavating material.

The chain is driven by appropriate drive units such as the motor-speed reducer 8, coupled to the sprocket wheels 4.

The planing tools 6 and the conveying tools 7 are displaced along the conveyor trough and the excavating trough. They are connected, e g. as shown at 22 and 23 to each of the tools 6 or 7. Preferably each tools is connected at its head portion and its end portion to the chain. The chain 5 has been illustrated in the drawing either by showing the links thereof or by a heavy dot-dash line.

Figure 2:
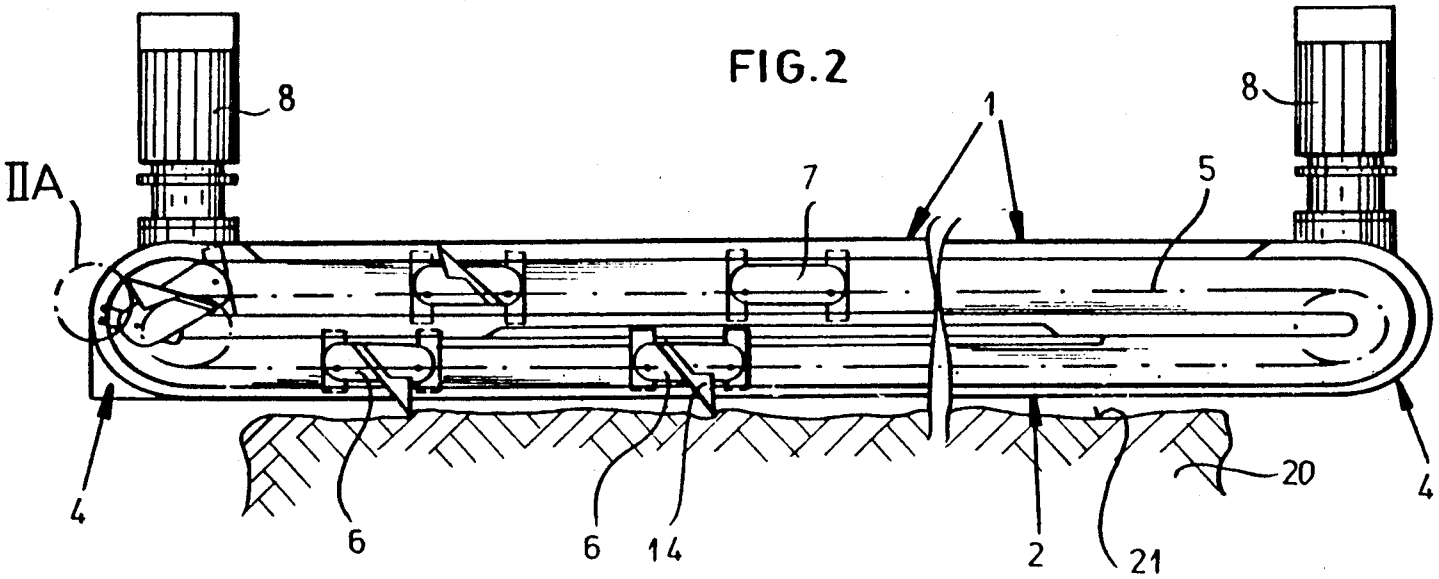
FIG. 2 is a top plan view showing the apparatus of FIG. 1 in reduced scale.

The conveyor trough 1 and the excavating trough 2 have guide elements 9 in the form of channels extending along them. The tools 6 and 7 have guide projections or ears 10 which engage in and are guided by the guide channels 9. As can be seen especially from FIG. 3, each planing tool 6 has a head portion 11 with two laterally-extending guide formations or lugs 10 engaging in the guide channels 9. It also has an end portion 12 with two laterally-extending guide lugs 10 which are correspondingly guided, and an intermediate portion 13. The same applies for the conveyor elements 7 which differ from the excavating tools 6, shown in FIGS. 3 and 4 substantially only by the absence of the cutters 14 which serve as planes for excavating the coal from the mining face. The conveyor tools 7, therefore, serve exclusively as conveyor flights while the excavating tools 6 serve both as conveyor flights and as planing tools as shown in FIG. 2.

Figure 3:
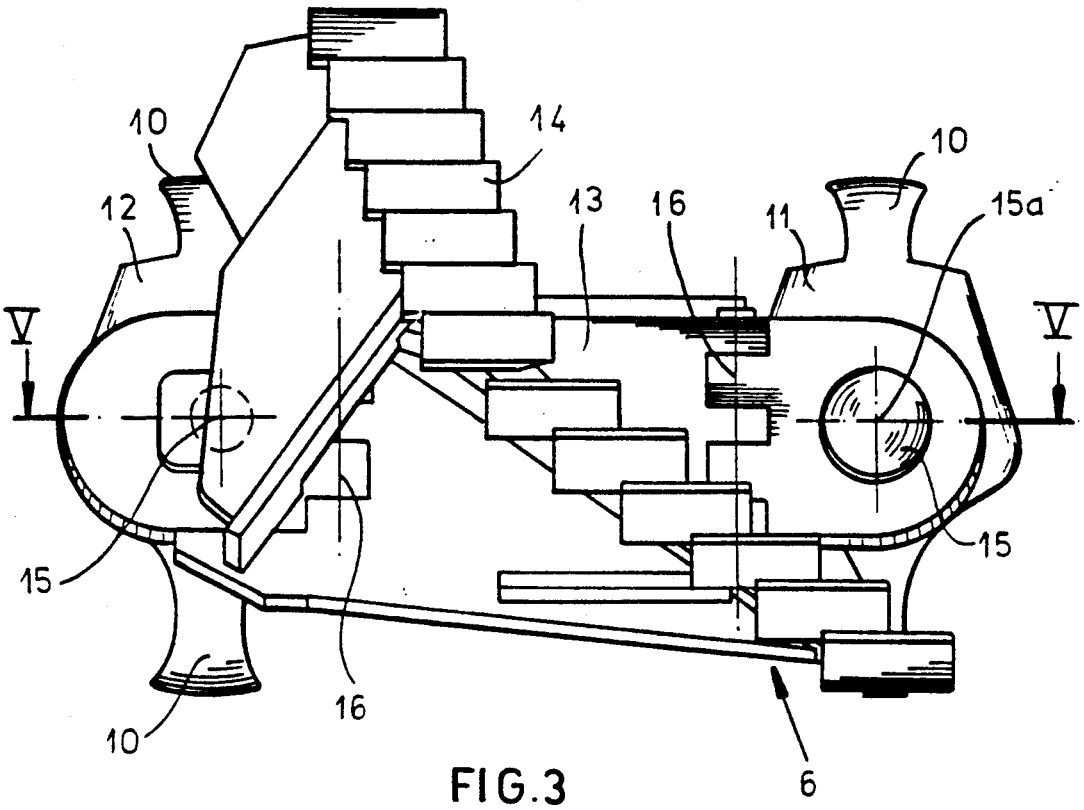
FIG. 3 is a plan view of a planing tool for the apparatus or FIG. 1, drawn to a larger scale.
Figure 4:
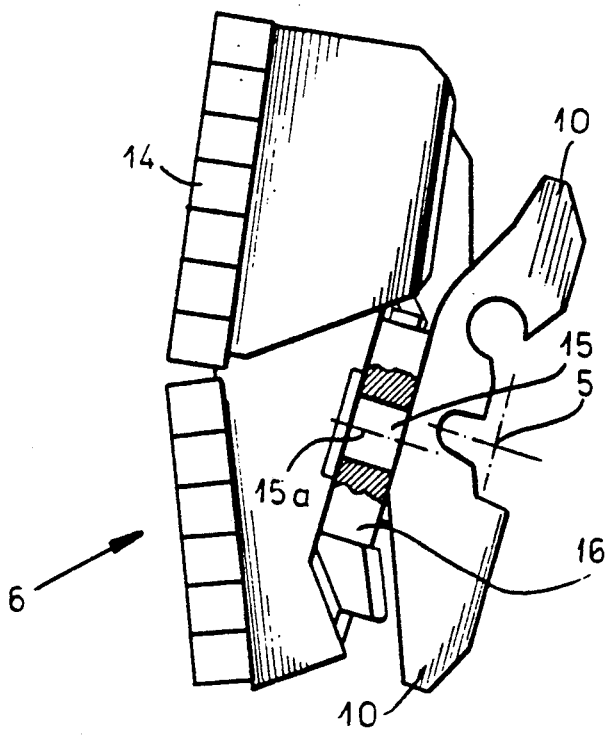
FIG. 4 is a side view of this apparatus, partly broken away.

The head portion 11 and the end portion 12 are pivotally connected to the intermediate portion 13 of the respective tool by pivots 15 as best seen in FIGS. 3 and 4. The pivots 15 define pivot axes 15*a*, which are perpendicular to the path of the chain 5 and are perpendicular to the bottom 24 of the conveyor trough 1.

Figure 5:
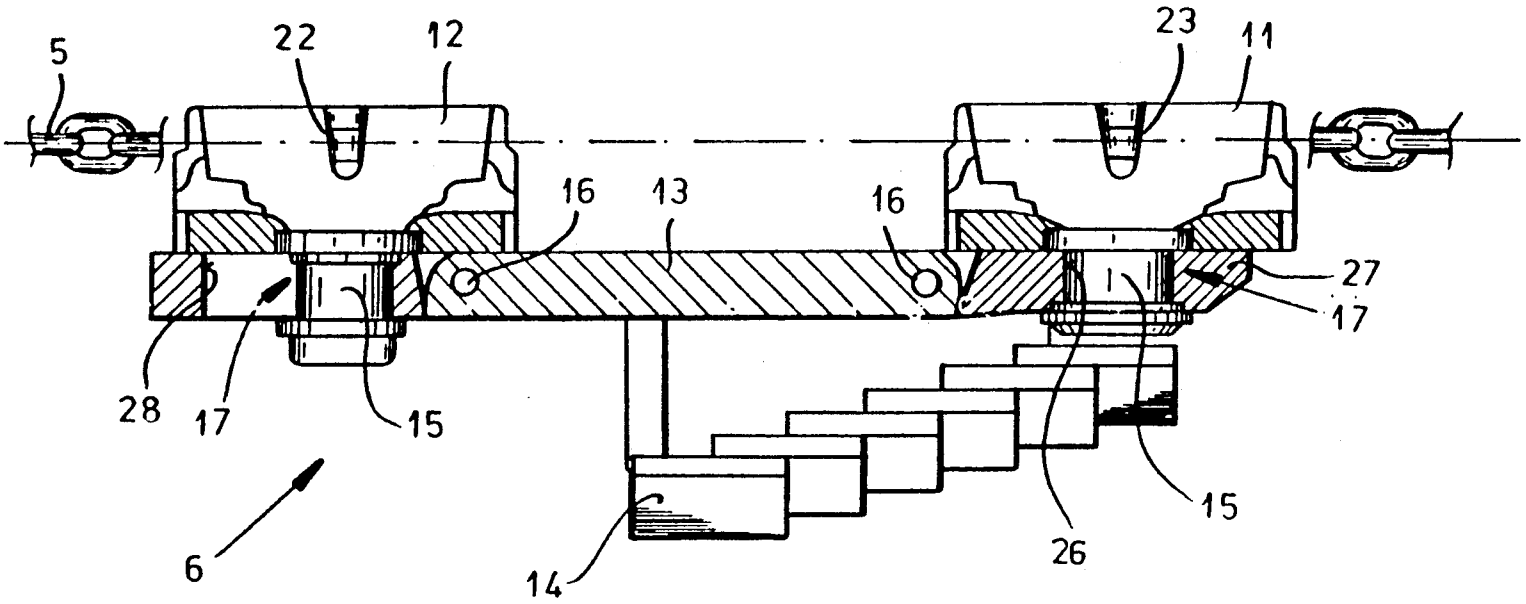
FIG. 5 is a section taken along the line V—V of FIG. 3.

Each of the pivot pins 5 may be received in a hole 26 of a plate 27 connected to the head portion 11 and forming part thereof, or a slot 28 forming part of the end portion 12 of the tool (see FIG. 5).

The intermediate portion 13 has, moreover, an additional hinge joint 16 between the end portion and head portion at locations respectively close to the pin joint 15. The axes of the hinged joint 16 is substantially orthogonal to the axes 15*a* of the pin joints.

Figure 2A:
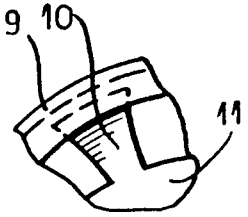
FIG. 2A is a detail of the region IIA of FIG. 2.

As can be seen from FIG. 2, and especially the detail view of FIG. 2A, the guide channels 9 extend into the regions of the direction-change devices 4. The guide lugs 10 are thus guided by these extensions of the channels 9 even in the regions of the direction-change devices. The pin-type pivot joints have been represented generically at 17.

The means for pivoting the trough 2 about a horizontal axis relative to the trough 1 is represented by the rod 30. This pivot axis may be the axis 3 or an axis defined at 3*a*, if desired.

I claim:

1. A seam-mining apparatus, comprising:

a conveyor trough having a substantially horizontal bottom and tool-guide channels on opposite longitudinal sides of said conveyor trough;

a substantially upright excavating trough ahead of said conveyor trough in a direction of advance of the apparatus toward a seam and extending along said conveyor trough, said excavating trough having at least one tool-guide channel extending therealong;

means for angularly adjusting orientation of said excavating trough about a horizontal axis relative to said conveying trough;

an excavating and conveying chain extending along said troughs;

direction-change devices at opposite ends of said troughs guiding said chain from said conveyor trough to said excavating trough and from said excavating trough to said conveying trough;

a multiplicity of tools spaced along said chain and coupled thereto for entraining excavated material along said conveyor trough, at least some of said tools being formed with planing formations for excavating material from said seam as said tools are displaced along said excavating trough, said tools comprising:

a head portion formed with a pair of laterally oppositely extending guide formations engageable in and guidable by said channels, an end portion spaced from said head portion and formed with a pair of laterally oppositely extending guide formations engageable in and guidable by said channels, an intermediate portion between said head portion and said end portion, respective first pivot means connecting said intermediate portion with said head portion and said end portion for relative pivotal movement about axes substantially perpendicular to a direction of travel of said chain and to said bottom as said tools travel along said conveyor trough, respective second pivot means connecting said intermediate portion with said head portion and said end portion for relative pivotal movement about axes substantially orthogonal to said axes of said first pivot means; and further guide channels formed in regions of said direction-change devices and receiving at least one of said guide formations of each of said head portion and end portion of each tool as each tool is guided respectively from said conveyor trough to said excavating trough and from said excavating trough to said conveying trough.

2. The apparatus defined in claim 1 wherein said first pivot means are respective pin-and-hole pivot joints.

3. The apparatus defined in claim 2 wherein said second pivot means are respective hinge joints.

4. The apparatus defined in claim 1 wherein said second pivot means are respective hinge joints.

5. The apparatus defined in claim 1 wherein some of said tools are exclusively conveyor tools free from said planing formations.

6. The apparatus defined in claim 1 wherein said tools are connected to said chain at the respective head and end portions.

* * * * *